United States Patent [19]

Schulz, Jr.

[11] Patent Number: 4,809,958

[45] Date of Patent: Mar. 7, 1989

[54] FOUNDATION UNIT HAVING SPRING WIRE ELEMENTS

[75] Inventor: Martin Schulz, Jr., Brenham, Tex.

[73] Assignee: Steadley Company, Carthage, Mich.

[21] Appl. No.: 173,109

[22] Filed: Mar. 28, 1988

[51] Int. Cl.[4] ..... A47C 23/00; F16F 3/02

[52] U.S. Cl. ..... 267/81; 5/247; 5/255; 5/260; 267/103; 267/100; 267/85

[58] Field of Search ..... 267/85–112, 267/166, 81, 180; 5/246–277, 282, 243, 245, 241, 242

[56] References Cited

U.S. PATENT DOCUMENTS

| | | | |
|---|---|---|---|
| 3,761,972 | 10/1973 | Bihun et al. | 5/247 |
| 3,953,903 | 5/1976 | Lawrence et al. | 5/267 |
| 4,003,563 | 1/1977 | Taylor | 5/259 B X |
| 4,218,790 | 8/1980 | Mizelle | 5/255 X |
| 4,253,208 | 3/1981 | Hancock et al. | 5/247 |
| 4,339,834 | 7/1982 | Mizelle | 267/103 X |
| 4,398,705 | 8/1983 | Mizelle | 5/247 X |
| 4,664,361 | 5/1987 | Sasaki | 5/267 X |

*Primary Examiner*—Douglas C. Butler
*Attorney, Agent, or Firm*—Lee & Smith

[57] ABSTRACT

A foundation unit having a top bearing grid structure secured to a bottom substructure by intermediate support elements. The grid structure comprises a series of spaced longitudinal and transverse spring elements, each spring element being formed to permit elastic elongation thereof. Elastic elongation is accomplished by a series of V-shaped segments in each of the spring elements, the segments being located at the intersections of the spring elements and being joined by a clip. The support elements comprise wire elements which are L-shaped and which are composed of two planar portions connected at right angles to one another. The wire elements are located in transverse rows with the orientation of the wire elements in each row being opposite to the orientation of the wire elements in the adjacent row so that loads applied to the foundation unit are balanced.

20 Claims, 1 Drawing Sheet

Fig.1.
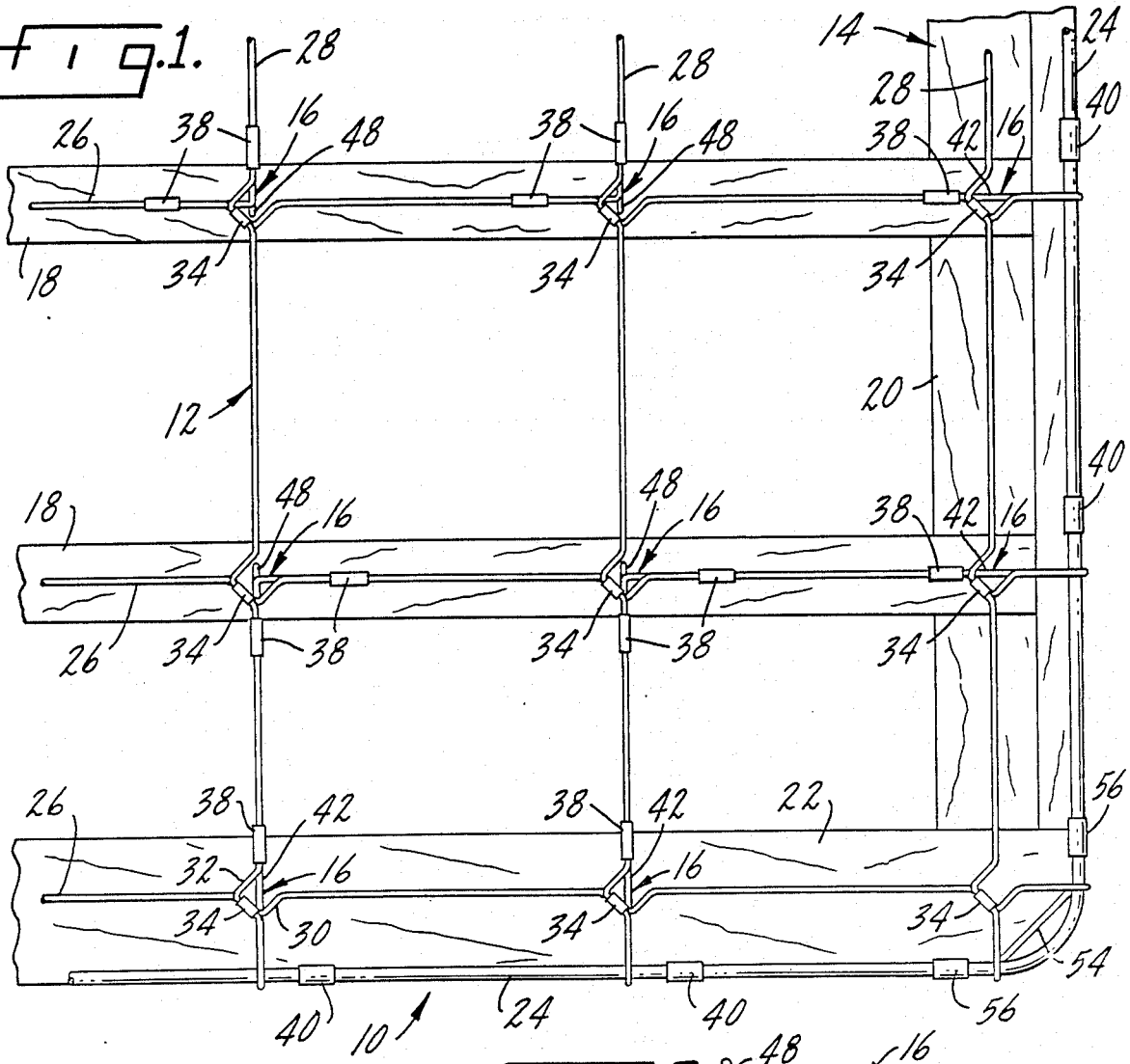
Fig.3.
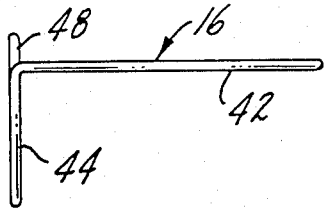
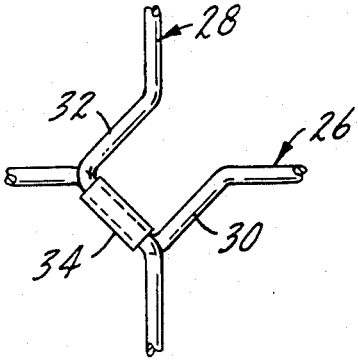
Fig.2.
Fig.5.
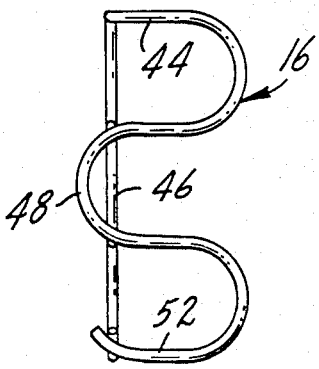
Fig.4.
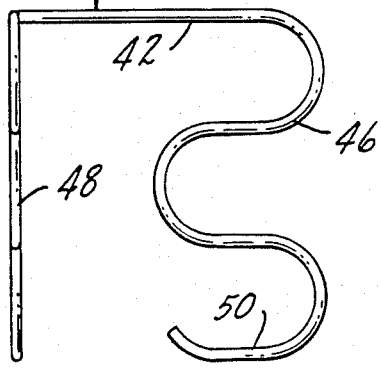

FOUNDATION UNIT HAVING SPRING WIRE ELEMENTS

BACKGROUND OF THE INVENTION

This invention relates to foundation units, and more particularly to a foundation unit having spring characteristics in both the top lattice wire structure and the wire supports for the lattice structure.

Foundation units, typically box springs, are generally rectangular in shape with a top grid structure, a wooden bottom substructure, and spring supports intermediate the top and the bottom to provide the desired resiliency of the foundation unit. In the typical foundation unit, the grid structure is composed of a series of interlaced wires which are welded at their intersections and which are joined, either by welding or wrapping, to an outer perimeter border wire. The resiliency of the foundation unit is provided by springs, which are generally oriented either beneath the intersectins of the grid wires, or between adjacent pairs of the grid wires, as illustrated in U.S. Pat. No. 3,953,903, assigned to the Assignee of the present application. While such foundation units may vary in details, all such foundation units utilize a rigid top grid structure which is not intended to provide any of the spring resiliency of the foundation unit.

SUMMARY OF THE INVENTION

The invention is directed to a foundation unit which is generally rectangular in shape and which has a top bearing grid or lattice structure, a bottom substructure, and support means intermediate the top and bottom structures for maintaining the top and bottom structures in a generally parallel, spaced relationship, and for providing some of the flexibility of the foundation unit. In accordance with the preferred embodiment of the invention, the top bearing structure comprises a plurality of spaced, longitudinal spring elements and spaced, transverse spring elements which lie in a plane and which intersect one another at cross points throughout the area of the top of the foundation unit. The longitudinal and transverse spring elements are joined at the intersections thereof. Each of the spring elements includes means permitting elastic elongation of the spring elements when under load.

In accordance with the preferred embodiment of the invention, the joining of the spring elements to one another and the joining of support means to the spring elements is accomplished by means of a clip. The clip joins the spring elements to one another at each intersection of the spring elements and joins the support means to the spring elements where contiguous.

The elastic elongation means comprises a series of deformation segments located in each spring element. In accordance with the preferred embodiment of the invention, each deformation segment comprises a V-shaped portion of the spring element. The V-shaped portions of the longitudinal and transverse spring elements are located at the intersections of the spring elements, and are joined together with a clip at that location.

The wire support elements may be similar to those disclosed in co-pending U.S. patent application Ser. No. 915,980, filed Oct. 6, 1986 and assigned to the Assignee of the present invention. Each of the wire elements includes a pair of linked upper attachment segments, a pair of planar central segments extending from opposite ends of the upper attachment segments, and a pair of lower attachment segments, each of the lower attachment segments being parallel to a respective upper attachment segment and being connected a respective central segment. Each of the central segments extends between one of the upper attachment segments and the associated lower attachment segment. The central segments are situated at right angles to one another so that portions of each wire element extend parallel to both the longitudinal and transverse spring elements. In accordance with the preferred embodiment of the invention, one of the central segments is offset from the other in the transverse direction when the foundation unit is assembled, with the wire elements thus being essentially L-shaped.

BRIEF DESCRIPTION OF THE DRAWINGS

The invention is described in greater detail in the following description of an example embodying the best mode of the invention, taken in conjunction with the drawing figures, in which:

FIG. 1 is a top plan view of a portion of a foundation unit according to the invention, with the remainder of the foundation unit being identical, as described in further detail below.

FIG. 2 is an enlarged top plan view of a typical junction of the longitudinal and transverse spring elements of the invention, showing the clip for attaching the spring elements at their intersection, FIG. 3 is an enlarged top plan view of one of the support elements of the invention which, as shown in FIG. 1, is located beneath each of the intersectios of the longitudinal and transverse spring elements, FIG. 4 is a front elevational view of the spring element of FIG. 3, and FIG. 5 is a left side elevational view of the spring element of FIG. 3.

DESCRIPTION OF AN EXAMPLE EMBODYING THE BEST MODE OF THE INVENTION

A foundation unit according to the invention is shown generally at 10 in FIG. 1. The foundation unit is composed of three basic elements, a top bearing structure 12, a bottom substructure 14, and support elements 16 intermediate the top structure 12 and the bottom substructure 14 for maintaining the top and bottom structures in a generally parallel, spaced relationship. The foundation unit 10, typically a box spring, may be formed in any size of shape necessary to form a foundation for a bedding unit.

The bottom substructure 14 is not unique and forms no part of the invention (other than being a part of the assembled foundation unit), and may be constructed in a conventional fashion from wooden members. The bottom substructure 14 illustrated has a series of cross slats 18 extending between longitudinal side slats 20. Opposite ends of the longitudinal side slats 20 are capped by end slats 22. The slats are glued, stapled, nailed or otherwise affixed to one another as necessary. A similar arrangement for the slats is illustrated in U.S. Pat. No. 4,377,279, the disclosure of which is incorporated herein by reference.

The top bearing structure 12 is a grid or lattice wire network composed of a perimeter border member 24 and a series of parallel transverse rows 26 and longitudinal columns 28 of spring elements extending between opposite edges of the perimeter border member 24. The perimeter border member 24 and the spring elements 26 and 28 are preferably formed from high carbon spring wire, as is typical in the foundation industry. The ends of the spring elements 26 and 28 may be wrapped about the perimeter border member 24, and may be otherwise affixed thereto, such as by welding.

Throughout the area of the top of the foundation unit 10, the transverse spring elements 26 and longitudinal spring elements 28 intersect. One of the intersections is shown in an enlarged fashion in FIG. 2. At each intersection, each of the spring elements 28 includes a deformation segment in the form of a V-shaped portion. The transverse spring element 26 includes a V-shaped portion 30, and the longitudinal spring element 28 includes a V-shaped portion 32. As shown, the V-shaped portion 32 overlies the V-shaped portion 30, and the intersection of the spring elements 26 and 28 is completed by a joining respective legs of the V-shaped portions 30 and 32 by a clip 34.

The V-shaped portions 30 and 32 act as spring sections, which deform under load. In addition, by locating the V-shaped portions at the intersections of the spring elements 26 and 28, the spring elements may be joined by means of the clips 34, rendering unnecessary welding of cross members of a grid wire top bearing structure as in a conventional foundation unit.

The transfer spring elements 26 and longitudinal spring elements 28 are located in contiguous parallel planes and, for the purposes of description herein, will be considered lying in essentially the same plane. In addition, the spring elements 26 have been referred to as "transverse", while the spring elements 28 have been referred to as "longitudinal". It should be evident that the terms "transverse" and "longitudinal" are relative and are interchangeable. Typically, the term "longitudinal" is intended to refer to the lengthwise dimension of a foundation unit (head-to-toe), while "transverse" refers to the side-to-side dimension of the foundation unit.

For support of the top bearing structure 12 above the bottom substructure 14, and the add resiliency to the structure of the foundation unit 10, a series of support means in the form of the wire support elements 16 are employed, with a support element 16 being located at each intersection of the spring elements 26 and 28. Each of the support elements 16 is attached to the spring elements 26 and 28 by means of clips 38. Slightly larger clips 40 are used to attach the support elements 16 at the edges of the foundation unit 10 to the perimeter border member 24, which is larger in diameter than the spring elements 26 and 28.

Each of the support elements 16 is preferably formed of a single length of wire bent into the shape shown in the drawing figures, and is composed of a pair of linked upper attachment segments 42 and 44, a pair of sinuous planar central segments 46 and 48, and a pair of lower attachment segments 50 and 52. Each of the lower segments 50, 52 is parallel to its respective upper attachment segment 42, 44, with the respective planar central segment 46, 48 extending therebetween. From the top view, as shown in FIG. 3, each of the support elements 16 is L-shaped.

The clips 38 (and 40 in the instance of support elements 16 adjacent the edges of the foundation unit 10) are affixed to the upper attachment segments 42 and 44. The lower attachment segments 50 and 52 may be affixed to the cross slats 18, or end slats 22, as the case may be, by conventional stapling or nailing, or any other suitable means. The support elements 16 are L-shaped, with the central segment 46 being laterally offset from the central segment 48, permitting the use of relatively narrow cross slats 18, as illustrated. The longer legs of the support elements 16 are aligned in the longitudinal direction of each of the cross slats 18, while the longer legs of the support elements 16 which are attached to the perimeter border member 24 are arranged laterally across either the end slats 22 or side slats 20.

As illustrated in FIG. 1, a support element 16 is located at each intersection of the transverse and longitudinal spring elements 26 and 28. The support elements 16 are connected to the spring elements 26 and 28 in transverse rows with the orientation of the support elements in each row being opposite to the orientation of the support elements in the adjacent row for stability purposes. Such orientation of the support elements 16 continues throughout the remainder of the foundation unit in alternating rows to resist any end and side loads applied to the foundation unit 10.

In addition to the support elements 16, the foundation unit 10 also includes a corner element 54 in each of the four corners. The corner element 54 is secured to the perimeter border member 24 by means of a pair of clips 56. The corner element 54 is essentially similar to the support elements 16, but instead of being L-shaped, includes two portions at right angles to one another, interconnected by means of a straight top section at 45° to each of the portions. The corner element 54 may be identical to that disclosed in co-pending U.S. Patent application Ser. No. 915,980, filed October 6, 1986 which is incorporated herein by reference.

ACHIEVEMENTS

The present invention provides a versatile, easily-assembled foundation unit which has spring characteristics not only in the vertical support elements 16, but also in the lattice of transverse and longitudinal spring elements 26 and 28. The individual V-shaped portions 30 and 32 of the respective spring elements 26 and 28 provide elastic elongation of the spring elements 26 and 28. In other words, rather than being straight, unstretching members as in prior art grids (such as that of U.S. Pat. No. 4,377,279), the spring elements 26 and 28 actually stretch in length, when loaded, and return to their rest states when unloaded, contributing to the resiliency of the foundation unit 10.

By providing each of the spring elements 26 and 28 with the V-shaped portions 30 and 32 at the intersections of the spring elements, the spring elements 26 and 28 can be clipped together rather than welded as in the past. Joining of the V-shaped portions results in a structure which allows no movement in the horizontal plane, while allowing motion in the vertical plane due to rotation of the junction of the spring elements 26 and 28 within each of the clips 34.

The supporting wire elements 16, being composed of two convolutions of wire at right angles to one another, gives support to the foundation unit 10 in two vertical planes. With the attachment of the supporting wire elements 16 to alternating transverse spring elements 26 and longitudinal spring elements 28, the intersections of the spring elements are reinforced, and the foundation unit 10 resists any end and side loads that may be applied. Alternate facing of the directions of the support elements 16 in alternating rows of the foundation unit balance the side and end load resistance of the foundation unit 10.

The lattice grid wire top bearing structure 12 of the foundation unit is an active part of the overall resiliency of the foundation unit 10, rather than a passive welded structure as in the past. Therefore the support elements 16 are joined by the spring elements 26 and 28 to provide an aggregate resiliency for the foundation unit 10 not possible in prior art foundation units having rigid grid wire top bearing structures.

Various changes can be made to the invention without departing from the spirit thereof or scope of the following claims.

What is claimed is:

1. In a foundation unit which is generally rectangular in shape and which has opposite longitudinal end edges and opposite lateral side edges, the foundation unit further having a top bearing structure, a bottom substructure and support means intermediate the top and bottom structures for maintaining the top and bottom structures in a generally parallel, spaced relationship, the improvement comprising a. the top bearing structure comprising a plurality of spaced longitudinal spring elements extending between said end edges and spaced transverse spring elements extending between said side edges, said spring elements lying in a plane with said longitudinal spring elements intersecting said transverse spring elements, and each spring element including means permitting elastic elongation of said spring element, said elastic elongation means comprising a plurality of expansion sections which deform under load, and b. means joining said longitudinal and transverse spring elements at intersections thereof.

2. The foundation unit according to claim 1 in which said joining means comprises a clip at each intersection.

3. The foundation unit according to claim 1 in which said elastic elongation means comprises a series of deformation segments located in each spring element.

4. The foundation unit according to claim 3 in which each deformation segment comprises a V-shaped portion of the spring element.

5. The foundation unit according to claim 4 in which said V-shaped portions of said longitudinal and transverse spring elements are located at the intersections of said spring elements.

6. The foundation unit according to claim 5 in which said joining means comprise a clip at each intersection joining the V-shaped portion of a longitudinal spring element to the V-shaped portion of a transverse spring element.

7. The foundation unit according to claim 1 in which said support means comprises a plurality of wire elements, each including i. a pair of linked upper attachment segments, ii. a pair of planar central segments extending from opposite ends of said upper attachment segments, and iii. a pair of lower attachment segments, each parallel to a respective upper attachment segment and connected to a respective central segment, each central segment extending between an upper attachment segment and an associated lower attachment segment.

8. The foundation unit according to claim 7 in which said central segments are situated at right angles to one another.

9. The foundation unit according to claim 8 in which one central segment is offset from the other.

10. The foundation unit according to claim 7 in which a wire element is located at each intersection of said longitudinal and transverse spring elements.

11. The foundation unit according to claim 1 in which said support means comprises a plurality of wire elements, one wire element being located at each intersection of said longitudinal and transverse spring elements.

12. The foundation unit according to claim 11 in which each wire element comprises a generally planar longitudinal portion and a generally planar transverse portion, said longitudinal portion being secured to a longitudinal spring element and said transverse portion being secured to a transverse spring element, and means rigidly connecting said longitudinal portion to said transverse portion.

13. The foundation unit according to claim 12 in which said portions are secured to said spring elements with clips.

14. The foundation unit according to claim 11 in which said wire elements are L-shaped and comprise two planar portions connected at right angles to one another, said wire elements being connected to said spring elements in transverse rows with the orientation of said wire elements in each row being opposite to the orientation of the wire elements in the adjacent row.

15. A foundation unit comprising a. a bottom substructure, b. a top bearing structure comprising a generally planar plurality of spaced longitudinal spring elements extending between end edges of the top bearing structure and spaced transverse spring elements extending between side edges of the top bearing structure with said spring elements intersecting one another, each spring element including a series of deformation segments, said segments comprising a plurality of expansion sections which deform under load, c. support means intermediate the top bearing structure and the bottom substructure, said support means comprising a series of spaced wire elements each located at an intersection of said spring elements, and d. means joining said longitudinal and transverse spring elements at the intersections thereof.

16. The foundation unit according to claim 15 in which said elastic elongation means comprises a series of deformation segments located in each spring element.

17. The foundation unit according to claim 16 in which each deformation segment comprises a V-shaped portion of the spring element.

18. The foundation unit according to claim 17 in which said V-shaped portions of said longitudinal and transverse spring elements are located at the intersection of said spring elements.

19. The foundation unit according to claim 18 in which said joining means comprise a clip at each intersection joining the V-shaped portion of a longitudinal spring element to the V-shaped portion of a transverse spring element.

20. The foundation unit according to claim 15 in which said wire elements are L-shaped and comprise two planar portions connected at right angles to one another, said wire elements being connected to said spring elements in transverse rows with the orientation of said wire elements in each row being opposite to the orientation of the wire elements in the adjacent row.

* * * * *